United States Patent [19]

Cleveland, Jr.

[11] Patent Number: 4,646,990

[45] Date of Patent: Mar. 3, 1987

[54] MAGNETIC ROLL SENSOR CALIBRATOR

[75] Inventor: William C. Cleveland, Jr., Santa Ana, Calif.

[73] Assignee: Ford Aerospace & Communications Corporation, Detroit, Mich.

[21] Appl. No.: 830,154

[22] Filed: Feb. 18, 1986

[51] Int. Cl.[4] ..... F41G 7/00

[52] U.S. Cl. ..... 244/3.21

[58] Field of Search ..... 244/3.21, 3.1, 166, 244/171

[56] References Cited

U.S. PATENT DOCUMENTS

| | | | |
|---|---|---|---|
| 3,397,358 | 8/1968 | Allenden et al. | 324/47 |
| 3,414,215 | 12/1968 | Martin et al. | 244/3.15 |
| 3,860,199 | 1/1975 | Dunne | 244/3.21 |
| 4,109,199 | 8/1978 | Ball et al. | 324/202 |
| 4,114,451 | 9/1978 | Crittenden et al. | 244/3.21 |
| 4,166,406 | 9/1979 | Maughmer | 89/1.815 |
| 4,328,938 | 5/1982 | Reisman et al. | 244/3.21 |

*Primary Examiner*—Charles T. Jordan

*Attorney, Agent, or Firm*—Edward J. Radlo; Keith L. Zerschling

[57] ABSTRACT

A coil (21) mounted inside a spinning guided object (20) has an electrical current (i) induced therewithin by means of interaction with the earth's magnetic field (B). A similar coil (22) mounted on the launch platform spins at the same rate (W) as the object's coil (21), although these two coils (22, 21) are not necessarily in phase. Apparatus (35) associated with the launch platform generates a constant phase signal (P) having amplitude and sign representing the phase difference between the signal generated by the launch platform's coil (22) and the vertical direction. This phase information (P) is used to correct the guidance commands sent from the launch platform to the guided object (20), or, alternatively, is fed directly to the guided object (20) for correction by said object's on-board computer. A hold fire indicator (33) is provided to inform the operator when the output from the launch platform's coil (22) is above or below a predetermined level sufficient for adequate roll angle compensation.

8 Claims, 4 Drawing Figures

MAGNETIC ROLL SENSOR CALIBRATOR

TECHNICAL FIELD

This invention pertains to the field of establishing a roll angle reference for a spinning guided object, by means of using the earth's magnetic field.

BACKGROUND ART

U.S. Pat. No. 3,860,199 discloses in cols. 9 and 10 an electromagnetic roll angle calibrator for a spinning projectile using coils located on the projectile and on its launch platform, respectively. The reference differs from the present invention in that:

1. The reference measures two voltages on the waveform produced by the coil located on the launch platform, one voltage at a peak of the waveform and the other corresponding to the vertical direction. A signal proportional to the ratio of these two voltages is then sent to the spinning projectile, which requires an onboard computer to apply this voltage ratio against the waveform measured by the spinning coil on board the projectile. The present invention measures a phase angle, not a ratio of two voltages; and the corrections can be made on the ground, which is much simpler than introducing a computer into the projectile to make the corrections.

2. The reference apparatus makes no attempt to equalize the rotation rates of the launch platform's coil and the projectile's coil as in the present invention.

3. The reference does not disclose a hold-fire indicator as in the present invention.

4. The reference's projectile's coil 37 is offset from the spin axis of the projectile.

Secondary references are U.S. Pat. Nos. 3,397,358; 3,414,215; 4,109,199; 4,166,406; and 4,328,938.

DISCLOSURE OF INVENTION

The present invention is a system for determining the roll angle of a guided object (20) that is launched from a launch platform and spins about its roll axis (z) during its subsequent flight. The invention comprises a portion on board the guided object (20) and a portion fixedly mounted with respect to the launch platform.

On board the guided object (20) is a first coil (21) which has an electrical voltage induced therewithin by the earth's magnetic field (B) as the guided object (20) spins along its trajectory.

Mounted on the launch platform is a second coil (22) which spins about one of its axes at the same rate (W) as the first coil (21). The second coil (22) thus also has an electrical voltage induced within it by the earth's magnetic field (B). Means (36, 34) are provided for correlating the amplitude of voltage induced within the second coil (22) with the vertical direction. Means (35) coupled to the second coil (22) and to the last-described means (34) are provided for measuring the phase angle (P) of the signal from the second coil (22) with respect to the vertical direction, and for conveying this phase information (P) to the spinning object (20), either directly or via guidance commands.

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
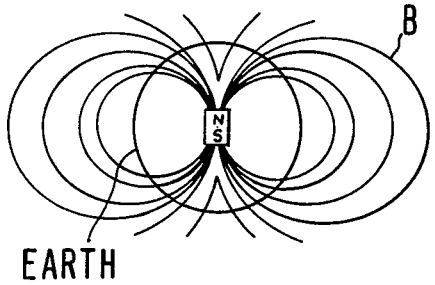
FIG. 1 is a sketch of the planet earth showing its magnetic field lines (B) emanating therefrom.

FIG. 1 shows that the planet earth can be thought of as having a giant magnet situated at its center. Magnetic field lines B emanate from the poles of this magnet and are generally arranged near vertically in the vicinity of the north and south polar regions of the earth's surface, and are generally arranged horizontally in the vicinity of the earth's equator.

Figure 2:
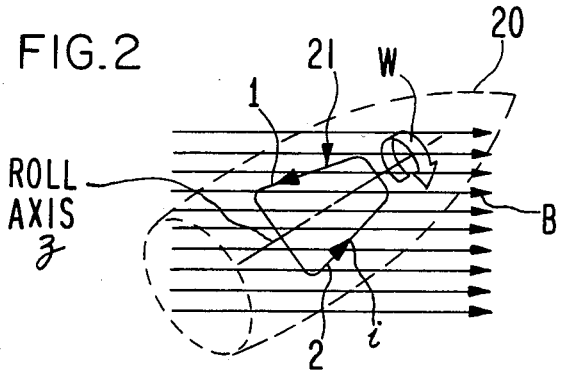
FIG. 2 is a sketch of the guided object (20) shown traversing a set of the earth's magnetic field lines (B)

FIG. 2 shows that an electrically conductive coil 21 is fixedly mounted with respect to guided object 20, which may be a projectile or missile. Object 20 spins at a rate W (typically 20 Hz to 40 Hz) about its roll axis z, which coincides with its elongated body axis. According to Faraday's law of induction, a spinning coil immersed in a magnetic field develops therewithin an induced electrical current. Thus, current i, shown by the arrows in FIG. 2, is induced within coil 21 as object 20, and hence coil 21, rotates within the earth's magnetic field lines B. Coil 21 can be constructed of multiple turns; this enables a stronger current i to be induced. The long axis of coil 21 is disposed to be coincident with the object's roll axis z, which lies within the plane of coil 21.

At the relatively low spin rates W of guided objects 20 of this nature, coil 21 acts as a pure resistance. Hence, the current i and voltage within coil 21 are in phase; therefore, "current" and "voltage" can be used interchangeably in the present context.

Figure 3:
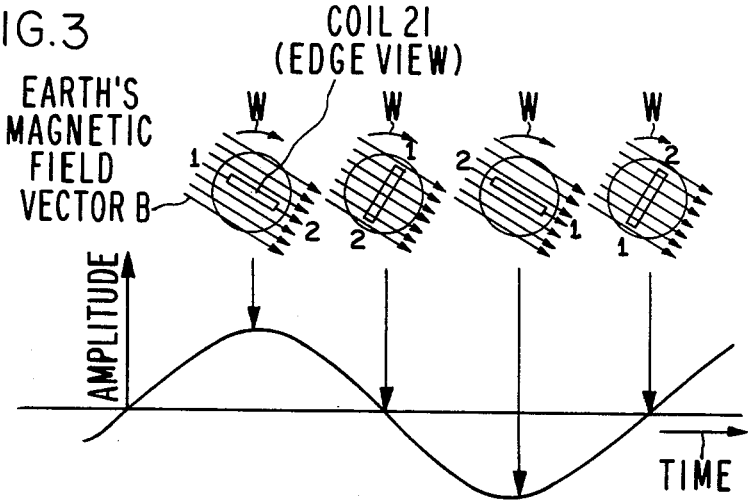
FIG. 3 is a graph of the sinusoidal current (or voltage) induced into the guided object's spinning coil (21) as a function of the angle of said coil (21) with respect to the earth's magnetic field lines (B)

For the configuration illustrated in FIG. 2, the current i (or voltage) induced in coil 21 is a maximum when roll axis z is orthogonal to the earth's magnetic field lines B. This is the scenario illustrated in FIG. 3. For this scenario, the maximum induced current i occurs when the plane of coil 21 is parallel to the magnetic field vectors B, i.e., the velocity vectors of coil edges 1 and 2 (as labeled in FIG. 2) are orthogonal to the field lines B. FIG. 3 shows the sinusoidal waveform generated within coil 21 for various geometries of coil 21 with respect to field lines B.

Such electromagnetic roll angle sensors have been used in projectile and missile flight tests, which have validated the practical applications of such a sensor. There are, however, two problems with the tactical utilization of this sensor. First, the phase angle of the coil 21 waveform relative to the vertical direction varies as a function of the latitude on the earth and the angle by which coil 21 cuts field lines B. Second, at the earth's magnetic equator or elsewhere, object 20 can have a trajectory such that its roll axis z is parallel to field lines B. For example, when object 20 is launched at the earth's magnetic equator, where the magnetic flux lines are parallel to the earth's surface, z is parallel to B when object 20 is fired due north or south. In such a case, coil 21 may not have sufficient sensitivity to function as a reliable roll reference. But this is not known to the launcher at the time of projectile or missile firing.

Figure 4:
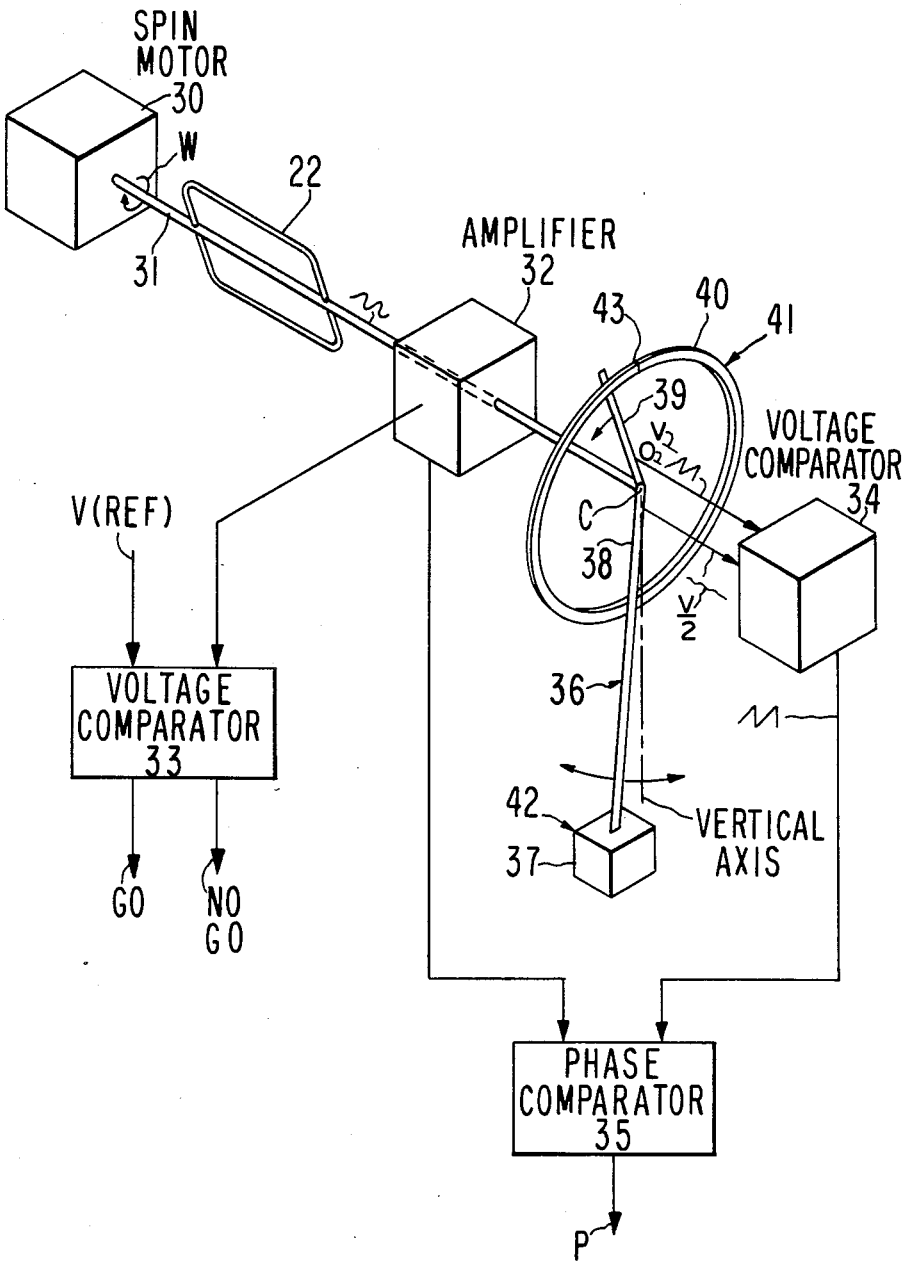
FIG. 4 is partly schematic, partly functional block diagram showing the portion of the present invention associated with the launch platform.

The subject magnetic roll sensor calibrator is designed to overcome these two limitations. The calibrator consists of a second roll sensor coil 22, preferably but not necessarily identical to coil 21, fixedly mounted on the launch platform. Prior to the object's launch, coil 22 is aimed at the same azimuth and elevation angle as object 20, i.e., the axis of rotation of coil 22 is parallel to the axis of rotation of coil 21. Coil 22 is spun at the same rate as coil 21, but these two coils 22, 21 are not necessarily in phase. As shown in FIG. 4, the output of spinning coil 22 is amplified by a low frequency amplifier 32 to facilitate subsequent processing.

Since the information needed to perform the correction is obtained prior to the launch of object 20, it is not necessary to take into account the slowing down of the roll rate W of object 20 as it continues along its trajectory. However, if it is desired to calibrate the roll reference continuously during said trajectory, coil 22 can be preprogrammed to slow down at the same rate as coil 21. Similarly, coil 22 can be gimbal mounted and its axis of rotation changed to stay parallel with the axis of rotation of coil 21 during the flight of object 20.

As shown in FIG. 4, the amplified output from coil 22 is compared against a vertical reference 36 fixedly mounted with respect to the launch platform. Vertical reference 36 can be a pendulum potentiometer, vertical gyro, attitude reference, or any suitable equivalent device. In FIG. 4, vertical reference 36 is illustrated to be a pendulum potentiometer. A potentiometer portion 41 comprises a continuously variable resistor 40 shaped as a circle lying in the plane of the vertical axis (an imaginary line connecting the center C of said circle with the center of the earth). A pendulum portion 42 comprises an electrically conductive wiper 38 which pivots about center C in a plane parallel to that of resistor 40 and which makes electrical contact with resistor 40. Wiper 38 is part of an elongated pendulum shaft which terminates in weight 37.

The launch platform, which may be on board an aircraft, tank, or ship, may be experiencing vibration and other random or periodic displacement with respect to the vertical axis. Thus, the signal taken from wiper 38 will typically be a jittering signal, as illustrated, having an average amplitude of V/2, where zero volts and V volts correspond to wiper 38 pointing straight up from its pivot point C (on respective sides of termination plane 43 of resistor 40), and V/2 represents wiper 38 pointing straight down and aligned with the vertical axis. This latter orientation is defined to be "vertical" or "in the vertical direction".

In the embodiment illustrated, potentiometer 41 has a second wiper 39 which, like wiper 38, pivots about point C in a plane parallel to that of resistor 40 and offset from that of wiper 38. Wiper 39 makes contact with resistor 40 on a surface of resistor 40 opposed to that of wiper 38. Wiper 39 is fixedly coupled to the shaft 31 around which coil 22 is made to rotate by spin motor 30. Thus, wiper 39 has the same rotation rate (W) as coil 22.

The voltage output from wiper 39 is a sawtooth (illustrated on FIG. 4) having superimposed thereon the same fluctuations experienced by the signal emanating from wiper 38, since the perturbations of the launch platform with respect to vertical affect both signals equally. Voltage comparator 34 subtracts the waveform produced by wiper 38 from that produced by wiper 39. The output of comparator 34 is thus a smooth sawtooth voltage, periodically linearly varying from zero volts to V volts, followed by an abrupt discontinuity from V volts to zero volts. This discontinuity represents wiper 39 crossing the discontinuity plane 43 of resistor 40 at wiper 39's upright position. The points on this waveform where wiper 39 is "vertical" (in a down position and aligned with the vertical axis) are where the sawtooth has an amplitude of V/2 volts. This sawtooth and the amplified output from coil 22 are then fed as the two inputs to phase comparator 35.

Phase comparator 35 is wired to measure the phase P of the signal from coil 22 at points in time when the signal from voltage comparator 34 equals V/2 volts, i.e., when coil 22 is "vertical". To compensate for a non-perfect vertical reference 36, phase comparator 35 can be built to contain an integrator which measures the average P over the first n sinusoids, where n is a preselected integer. Alternatively, since P (which has magnitude and sign) is theoretically a constant, it may be sufficient for phase comparator 35 to measure P just once.

P can be sent directly to object 20 for correction on board object 20 of the signal emanating from coil 21. On the other hand, it is preferable to perform the phase correction within the launch platform, because this is simpler and avoids the use of a computer or portion thereof on-board object 20. Thus, it is preferable to incorporate P into the guidance commands that are sent from the launch platform to object 20. These commands are sent by hardware or wireless.

The remaining portion of FIG. 4 pertains to the hold fire indicator portion of the system. If the calibrator sensor coil 22 voltage is below a preselected threshold level, a no-go (hold fire) output signal is generated by voltage comparator 33, which has as inputs the amplified output from coil 22 and a preselected reference voltage V(REF) corresponding to this threshold level. The threshold level can be based on empirical results of successful launches versus unsuccessful launches. The no-go signal alerts the operator to hold his fire until the launcher target angle has changed sufficiently so that the sensor coil 22 voltage is above the minimum operating level. This prevents wasted launches, and, secondly, gives confidence to the operator when signal strength is sufficient to permit normal operation.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. Apparatus for determining the roll angle of a spinning guided object that has been launched from a launch platform, said apparatus comprising:

on board the guided object, a first coil which has an electrical voltage induced therewithin by the earth's magnetic field as the guided object spins along its trajectory;

mounted on the launch platform, a second coil which spins about an axis at the same rate as the first coil, and thereby has an electrical voltage induced therewithin by the earth's magnetic field;

mounted on the launch platform, means for correlating the voltage within the second coil with the vertical direction, said correlating means having inputs coupled to the second coil and to a vertical reference, respectively; and means for conveying to the guided object the phase relationship between the voltage within the second coil and the vertical direction, said conveying means having inputs coupled to the second coil and to an output of the correlating means, respectively.

2. Apparatus of claim 1 wherein the phase relationship between the voltage within the second coil and the vertical direction is incorporated into guidance commands conveyed to the guided object from the launch platform.

3. Apparatus of claim 1 wherein the phase relationship between the voltage within the second coil and the vertical direction is sent directly to the guided object from the launch platform, said apparatus further comprising means on board the guided object for correcting the voltage measured at the first coil with said phase relationship.

4. Apparatus of claim 1 wherein the conveying means comprises a phase comparator having first and second inputs and an output, wherein:

the first input is coupled to a signal representing the voltage induced in the second coil;

the second input is coupled to a signal which emanates from the correlating means and periodically indicates when the second coil is in a vertical orientation; and the output conveys a signal representing the phase between the voltage within the second coil and vertical.

5. Apparatus of claim 1 wherein the correlating means comprises:

coupled to the spinning second coil, means for generating a first voltage proportional to the angle of rotation of the second coil about its axis of rotation;

means for generating a second voltage representing angular deviations from the vertical direction; and means for subtracting the second voltage from the first voltage to produce a signal which periodically indicates when the second coil is in a vertical orientation.

6. Apparatus of claim 1 further comprising means for determining when the voltage in the second coil is too weak to produce a reliable roll angle indication, said determining means comprising a comparator having first and second inputs and an output, wherein:

the first input is coupled to a signal representing voltage within the second coil;

the second input is coupled to a predetermined reference voltage; and the output conveys a signal indicating whether the roll angle indication is deemed to be reliable.

7. Apparatus of claim 1 wherein, during at least initial portions of the object's flight, the axis of rotation of the first coil is parallel to the axis of rotation of the second coil.

8. Apparatus of claim 1 wherein the first coil lies in a plane containing the guided object's spin axis.

* * * * *